US010427310B2

(12) United States Patent
Scimone et al.

(10) Patent No.: US 10,427,310 B2
(45) Date of Patent: Oct. 1, 2019

(54) CUTTING DEVICE

(71) Applicant: Slice, Inc., San Jose, CA (US)

(72) Inventors: Thomas Scimone, Campbell, CA (US); Scot Herbst, Santa Cruz, CA (US); Fu Keung Ng, Kowloon (HK)

( * ) Notice: Subject to any disclaimer, the term of this patent is extended or adjusted under 35 U.S.C. 154(b) by 0 days.

(21) Appl. No.: 15/853,736

(22) Filed: Dec. 23, 2017

(65) Prior Publication Data

US 2019/0193290 A1 Jun. 27, 2019

(51) Int. Cl.

| | |
|---|---|
| ***B26B 5/00*** | (2006.01) |
| ***B26B 29/02*** | (2006.01) |
| ***D05B 89/00*** | (2006.01) |
| ***A41H 31/00*** | (2006.01) |
| *B26B 1/08* | (2006.01) |

(52) U.S. Cl.

CPC ..... *B26B 5/003* (2013.01); *A41H 31/005* (2013.01); *B26B 29/025* (2013.01); *D05B 89/00* (2013.01); *B26B 1/08* (2013.01)

(58) Field of Classification Search

CPC ..... A41H 31/005; D05B 89/00; B26B 5/003; B26B 1/08

USPC ..... 30/162

See application file for complete search history.

(56) References Cited

U.S. PATENT DOCUMENTS 1,424,221 A * 8/1922 Trumpeter ..... F25C 5/043 30/162
2,948,961 A * 8/1960 Ortner ..... B26B 5/001 30/162
4,139,939 A * 2/1979 Crooks ..... B26B 5/003 30/162
D263,020 S * 2/1982 Rau, III ..... D8/99
4,769,912 A * 9/1988 Davis ..... B26B 1/08 30/162
5,222,951 A * 6/1993 Abidin ..... A61B 17/02 30/162
5,581,890 A * 12/1996 Schmidt ..... B26B 5/003 30/162
5,908,432 A * 6/1999 Pan ..... A61B 17/3213 606/167
6,044,562 A * 4/2000 Dillenbeck ..... B26B 5/003 30/162
6,161,290 A * 12/2000 Takamasa ..... B26B 5/003 30/162
6,192,589 B1 * 2/2001 Martone ..... B26B 5/001 30/162
6,550,144 B1 * 4/2003 Berns ..... B26B 5/003 30/162

(Continued)

*Primary Examiner* — Jason Daniel Prone
(74) *Attorney, Agent, or Firm* — Ellenoff Grossman & Schole LLP; James M. Smedley, Esq

(57) ABSTRACT

A cutting device is disclosed. The cutting device has a housing and a carriage that is movably disposed in the housing, the carriage being movable between a retracted position and an extended position. The cutting device also has a cutting member that is removably disposable in the carriage, a cover member that is removably attachable to the housing, and an urging member that operably connects the carriage and the housing. The housing includes a locking member. When the carriage is in the extended position and the cover member is attached to the housing, the locking member locks the cover member to the housing. The urging member urges the carriage to move from the extended position toward the retracted position.

20 Claims, 5 Drawing Sheets

(56) References Cited

U.S. PATENT DOCUMENTS 6,553,673 B2 * 4/2003 Peyrot ..... B26B 5/003 30/162
6,775,911 B2 * 8/2004 Tremblay ..... B26B 5/003 30/162
7,316,070 B2 * 1/2008 Green ..... B26B 5/001 30/162
7,621,051 B2 * 11/2009 Ping ..... B26B 5/00 30/162
7,765,701 B2 * 8/2010 Okada ..... B26B 5/003 30/162
7,891,098 B2 * 2/2011 Parker ..... B26B 5/003 30/162
8,065,803 B2 * 11/2011 Austin ..... B26B 5/003 30/162
8,769,826 B2 * 7/2014 Wu ..... B26B 5/003 30/162
9,358,692 B2 * 6/2016 Schekalla ..... B26B 1/08
9,364,958 B2 * 6/2016 Scimone ..... B26B 5/003
9,579,808 B2 * 2/2017 Scimone ..... B26B 5/003
9,662,796 B2 * 5/2017 Scimone ..... B26B 9/00
9,925,674 B2 * 3/2018 Scimone ..... B26B 5/003
10,124,495 B2 * 11/2018 Gallegos ..... B26B 5/001
10,219,567 B2 * 3/2019 Farnum ..... B26B 1/08
2004/0187314 A1 * 9/2004 Johnson ..... B26B 5/00 30/162
2005/0172496 A1 * 8/2005 Zeng ..... B26B 5/001 30/162
2005/0193568 A1 * 9/2005 Peyrot ..... B26B 5/001 30/162
2006/0130338 A1 * 6/2006 Dzubak ..... B26B 5/003 30/162
2009/0106983 A1 * 4/2009 Berns ..... B26B 5/003 30/162
2011/0041345 A1 * 2/2011 Austin ..... B26B 5/001 30/162
2011/0283542 A1 * 11/2011 Wu ..... B26B 5/003 30/162
2014/0041239 A1 * 2/2014 Scimone ..... B26B 9/00 30/346.53
2014/0317936 A1 * 10/2014 Wu ..... B26B 5/003 30/162
2015/0246452 A1 * 9/2015 Schmidt ..... B26B 5/003 30/162
2016/0031097 A1 * 2/2016 Wu ..... B26B 1/08 30/162
2016/0279812 A1 * 9/2016 Scimone ..... B26B 5/003
2017/0246748 A1 * 8/2017 Scimone ..... B26B 9/00
2018/0333871 A1 * 11/2018 Scimone ..... B26B 9/00

* cited by examiner

CUTTING DEVICE

TECHNICAL FIELD

The present disclosure generally relates to a cutting device, and more particularly to a cutting device having a replaceable blade.

BACKGROUND

Blade replacement typically occurs after tools such as seam rippers, box cutters, utility knives, and precision knives are used for a period of time. For example, seam rippers are tools used for removing attachments such as stitches and seams used in sewn articles. Over time, blades become dull with repeated use and are typically replaced. Replacing blades on conventional cutting tools such as, for example, steel blades, can often be difficult and unsafe. For example, a user may struggle with safely removing an old blade and replacing that old blade with a new, sharp blade. Users who are unfamiliar with a given tool using a steel or metallic blade may cut themselves as they try to detach an old blade and/or reattach a new blade such as a sharpened steel or metallic blade. Accordingly, a way for avoiding difficult replacement of sharp metallic blades and for safely using cutting devices exists.

The exemplary disclosed cutting device and method of the present disclosure is directed to overcoming one or more of the shortcomings set forth above and/or other deficiencies in existing technology.

SUMMARY OF THE DISCLOSURE

In one exemplary aspect, the present disclosure is directed to a cutting device. The cutting device includes a housing and a carriage that is movably disposed in the housing, the carriage being movable between a retracted position and an extended position. The cutting device also includes a cutting member that is removably disposable in the carriage, a cover member that is removably attachable to the housing, and an urging member that operably connects the carriage and the housing. The housing includes a locking member. When the carriage is in the extended position and the cover member is attached to the housing, the locking member locks the cover member to the housing. The urging member urges the carriage to move from the extended position toward the retracted position.

In another aspect, the present disclosure is directed to a method. The method includes providing a housing that includes a locking member and providing a cutting assembly, the cutting assembly including a cutting member that is removably disposed in a carriage. The method also includes disposing the cutting assembly in the housing, the cutting assembly being movable between a retracted position and an extended position, and removably attaching a cover member to the housing. The method further includes locking the locking member to the cover member by moving the cutting assembly to the extended position, the locked cover member retaining the cutting member, and applying an urging force that urges the cutting assembly to move from the extended position toward the retracted position.

DETAILED DESCRIPTION AND INDUSTRIAL APPLICABILITY

Figure 1:
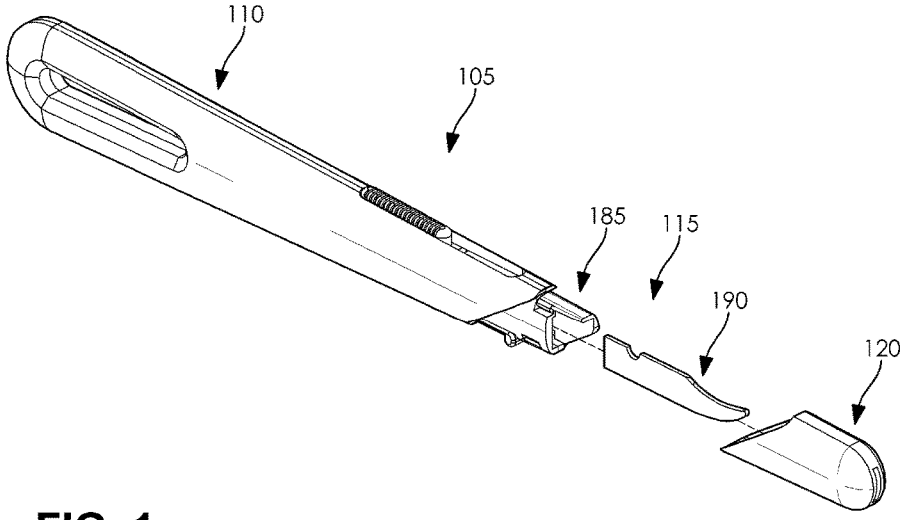
FIG. 1 is a perspective view of an exemplary cutting device in accordance with an embodiment of the present invention.
Figure 2:
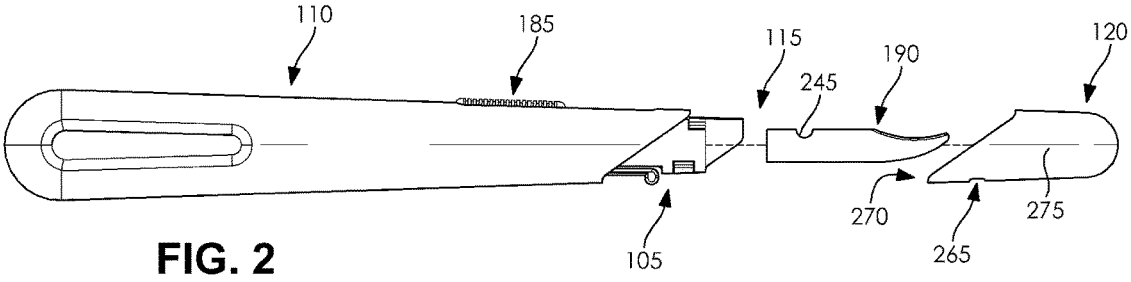
FIG. 2 is a side view of an exemplary cutting device in accordance with an embodiment of the present invention.

FIGS. 1 and 2 illustrate an exemplary cutting device 105. The exemplary cutting device disclosed herein may be any suitable device for cutting material such as, for example, a seam ripper, a box cutter, a utility knife, or a precision knife. For example, cutting device 105 may be a seam ripper or similar cutting device.

Cutting device 105 may include a housing 110, a cutting assembly 115, and a cover member 120. Cutting assembly 115 may be movably disposed in housing 110. Cover member 120 may be removably attachable to housing 110.

The exemplary cutting device may be constructed from any suitable variety of durable materials. For example, some or most of the components of the exemplary cutting device may be formed from plastic or a plastic composite material. Also for example, some or most of the components of the exemplary cutting device may be formed from metal or metal alloy. Further for example, the exemplary cutting device may include ceramic material. For example, cutting device 105 may be formed from plastic, plastic composite, metal, metal alloy, and/or ceramic materials. For example, cutting device 105 may be formed from a variety of materials disclosed herein. For example, housing 110 and/or cover member 120 may be formed partially or substantially entirely from plastic, plastic composite, metal, and/or metal alloy materials. For example, housing 110 and/or cover member 120 may be plastic or metal structural members. Weights included in housing 110, described further below, may be formed for example from metal material. As described further below, cutting assembly 115 may include components formed from plastic, plastic composite, metal, and/or metal alloy materials and components formed from ceramic materials. Also for example, certain components of cutting device 105 may include specific materials based upon the application or function of a given component. For example, members of cutting device 105 designed to come into contact with a cutting surface and that may be subject to constant friction may include materials resistant to friction such as glass-filled nylon and/or polyamide plastic. For example, cutting device 105 may include any suitable materials for use in a cutting device such as, e.g., a seam ripper, a box cutter, a utility knife, or a precision knife.

Housing 110 may provide, for example, a handle for cutting device 105 for use by a user. For example, housing 110 may be a seam ripper handle, or a handle of a box cutter, utility knife, or precision knife. For example, housing 110 may be a substantially hollow housing configured to receive and retain cutting assembly 115 as well as additional components such as the exemplary components described herein. For example, housing 110 may be a cylindrical housing. Also for example, housing 110 may be any other suitable shape such as, for example, a substantially regular tube shape, e.g., a square, triangular, hexagonal, and/or octagonal shape.

Figure 4:
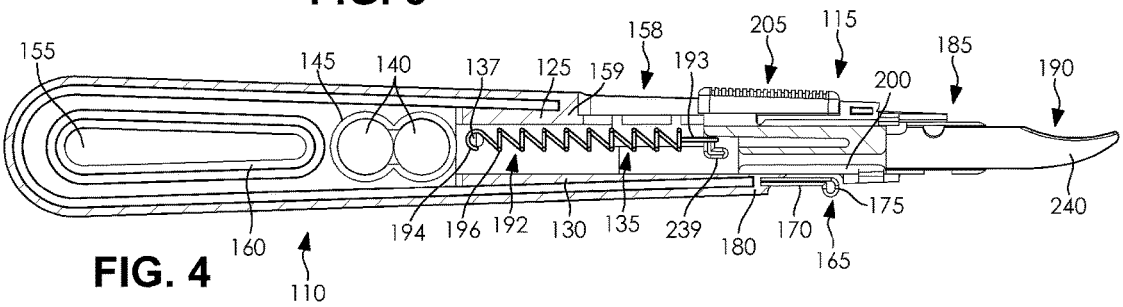
FIG. 4 is a sectional view of an exemplary cutting device in accordance with an embodiment of the present invention.

As illustrated in FIG. 4, housing 110 may include wall portions (e.g., portion 125 and portion 130). The plurality of wall portions may form a channel 135 within housing 110. Channel 135 may be configured to movably receive cutting assembly 115. For example, wall portions (e.g., portion 125 and portion 130) of housing 110 may act as ribs that fit into corresponding wall portions of cutting assembly 115. The interaction of corresponding wall portions (e.g., portions 125 and 130) of housing 110 and wall portions of cutting assembly 115 may prevent a rotation of cutting assembly 115 as it moves within housing 110. Housing 110 may include an attachment portion 137 that may protrude from one or more of the wall portions of housing 110. A portion of cutting assembly 115 may be attached to attachment portion 137 as described for example herein. Attachment portion 137 may be an integral portion of housing 110. Alternatively for example, attachment portion 137 may be formed from similar material as housing 110 and may be attached to housing 110.

Figure 5:
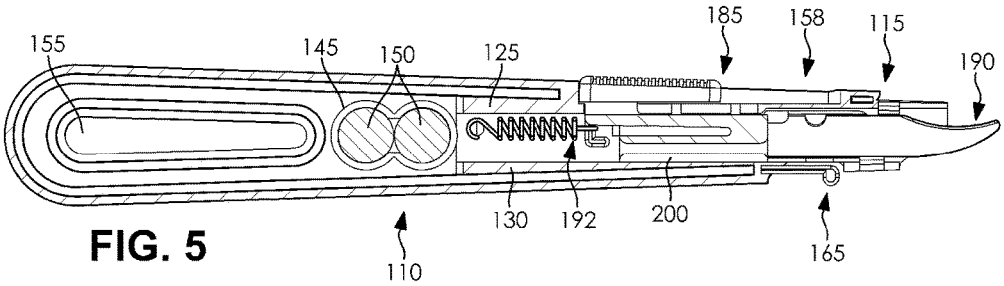
FIG. 5 is a sectional view of an exemplary cutting device in accordance with an embodiment of the present invention.

Housing 110 may include one or more cavities 140 that may be formed by a wall portion 145 of housing 110. As illustrated in FIG. 5, one or more cavities 140 may receive one or more weights 150. For example, weight 150 may be formed from relatively dense material such as metallic material. Because one or more weights 150 may be disposed away from (e.g., on another side of cutting device 105 away from) cutting assembly 115, weights 150 may add balance to cutting device 105 to help a user to better control a bladed end of cutting device 105. By providing a user with additional control, one or more weights 150 may help to provide for a suitable use of cutting device 105 by a user. Additionally for example, one or more weights 150 may provide additional balancing of cutting device 105 to provide suitable ergonomics to a user for the use of cutting device 105.

Housing 110 may include an aperture 155 formed by a wall portion 160. Aperture 155 may help facilitate a storage and/or carrying method for cutting device 105. For example, cutting device 105 may be placed on a hook or similar storage or carrying member via aperture 155.

Housing 110 may include an aperture 158 formed by a portion 159 of housing 110. Portion 159 may be, for example, a wall portion of housing 110 such as an exterior wall portion. Aperture 158 may receive a portion of cutting assembly 115. For example, aperture 158 may be an elongated aperture that movably receives a portion of cutting assembly 115. For example, aperture 158 may be an elongated aperture (e.g., an elongated groove) along which a portion of cutting assembly 115 may be moved.

Housing 110 may also include a locking member 165. Locking member 165 may be formed from a similar material as other components of housing 110 as disclosed for example herein. Locking member 165 may include a first portion 170 and a second portion 175. First portion 170 may be an elongated member that extends from housing 110. Locking member 165 may be an integral part of housing 110 extending from a portion 180 of housing 110. Housing 110 may also be attached to housing 110, for example at a portion 180. For example, portion 170 of locking member 165 may be a substantially flexible member that is movable relative to portion 180 of housing 110. For example, locking member 165 may be an elongated member that cantilevers out from portion 180 of housing 110 or from any other suitable location of housing 110. For example, locking member 165 may be a plastic or plastic composite cantilevered member. It is also contemplated that locking member 165 may be attached or may be an integral part of another component of cutting device 105 such as, for example, cutting assembly 115 or cover member 120.

Figure 3:
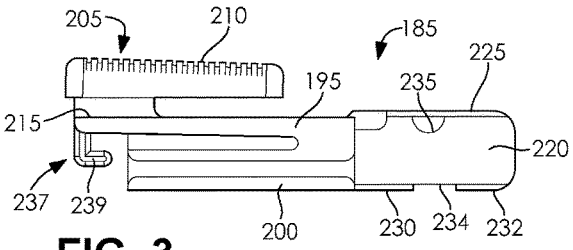
FIG. 3 is a perspective view of a component of an exemplary cutting device in accordance with an embodiment of the present invention.

Cutting assembly 115 may include a carriage 185, a cutting member 190, and an urging member 192. Cutting member 190 may be removably disposable in carriage 185 (e.g., a blade carriage). Carriage 185 may be movably disposed within housing 110. For example, carriage 185 may be movably disposed within channel 135, which may be configured to receive carriage 185. As illustrated in FIG. 3, carriage 185 may include a plurality of wall portions (e.g., portion 195 and portion 200). Wall portions (e.g., portion 125 and portion 130) of housing 110 may act as ribs that fit into corresponding wall portions (e.g., portion 195 and portion 200) of carriage 185. The interaction of corresponding wall portions (e.g., portions 125 and 130) of housing 110 and wall portions (e.g., portions 195 and 200) of carriage 185 may allow carriage 185 to move (e.g., slide or translate in a forward or rearward direction along a length of cutting device 105) within housing 110 without rotation (e.g., the interaction of the wall portions of carriage 185 and housing 110 may substantially prevent a rotation of carriage 185 as it moves within housing 110). For example, carriage 185 may move within housing 110 between an extended position as illustrated in FIG. 4 and a retracted position as illustrated in FIG. 5. For example, carriage 185 may be moved to the retracted position, the extended position, or any position between the retracted position and the extended position.

Carriage 185 may include a member 205. Member 205 may be a member that extends or protrudes from carriage 185. Member 205 may include a plurality of protrusions 210 such as ridges disposed on a surface of member 205. Member 205 may be received in aperture 158 of housing 110. Member 205 may be moved along a length of aperture 158. For example, a length of aperture 158 of housing 110 may define a range of movement through which member 205 may be moved (e.g., may define the range of movement through which carriage 185 may be moved within housing 110). Member 205 may be an integral portion of carriage 185. Alternatively, member 205 may be a member that is attached to a portion 215 of carriage 185. A user of cutting device 105 may interact with member 205 to move carriage 185 within housing 110. Protrusions 210 may assist a user with maintaining positive contact (e.g., non-slipping contact) with member 205 as the user pushes or pulls at member 205.

Carriage 185 may include a cavity 220 that may be formed by a plurality of portions (e.g., wall portion 225 and wall portions 230 and 232) of carriage 185. An aperture 234 may be disposed between portions 230 and 232. Cavity 220 may be configured (e.g., shaped and/or sized) to receive a portion of cutting member 190. A portion (e.g., portion 225) of cavity 220 may include a protrusion 235. Protrusion 235 may be configured to be received by a portion of cutting member 190 when cutting member 190 is received in cavity 220. Cavity 220 may securely retain cutting member 190 in such a manner so as to substantially prevent cutting member 190 from becoming dislodged or otherwise falling out of carriage 185. The securing of cutting member 190 in cavity 220 of carriage 185 may be a friction-fit attachment between cutting member 190 and wall portion 225, wall portion 230, wall portion 232, and/or protrusion 235 of carriage 185.

Carriage 185 may also include a portion 237 located at a rear portion of carriage 185 relative to a front portion of carriage 185 at which cavity 220 may be disposed. Portion 237 may include an attachment portion 239. A portion of urging member 192 may be attached to attachment portion 239. Attachment portion 239 may be, for example, a hook, ring, or portion having an aperture to which urging member 192 may be attached as described for example herein. Portion 237 including attachment portion 239 may be an integral portion of carriage 185. Alternatively for example, portion 237 including attachment portion 239 may be a separate member that is formed from similar material to carriage 185 and is attached to carriage 185.

Cutting member 190 may be any suitable blade or cutter for cutting of a material by cutting device 105. For example, cutting member 190 may be formed from a ceramic material that is capable of withstanding extended use before becoming dull or unusable. For example, cutting member 190 may be a ceramic blade. For example, cutting member 190 may include ceramic materials such as Zirconium Oxide or any other suitable ceramic materials for use in a blade. For example, cutting member 190 may be a ceramic blade that may be a hooked blade formed from Zirconium Oxide. Alternatively for example, cutting member 190 may be a metal blade or a blade formed from any suitable material than can be used for cutting materials. Cutting member 190 may include rounded tips to reduce the chance of a user being cut unintentionally by cutting member 190.

As illustrated in FIGS. 2 and 4, cutting member 190 may include a portion 240 that may be used for cutting material. Cutting member 190 may include a curved blade (e.g., portion 240). Portion 240 may be a relatively narrow portion (e.g., narrower relative the other portions of cutting member 190) of cutting member 190 that may serve to cut material. Cutting member 190 may also include an indentation or notch 245 that may receive protrusion 235 of carriage 185 to help retain cutting member 190 in carriage 185.

As illustrated in FIGS. 4 and 5, urging member 192 may be disposed in channel 135 of housing 110. Urging member 192 may have an end portion 193 and an end portion 194. End portion 193 may be attached to attachment portion 239 of carriage 185. End portion 194 may be attached to attachment portion 137 of housing 110. For example, end portions 193 and 194 may each be a hook or other suitable structural member for respectively attaching to attachment portions 239 and 137. Urging member 192 may accordingly be operably connected between carriage 185 and housing 110 via the attachment of end portion 193 to attachment portion 239 and the attachment of end portion 194 to attachment portion 137.

Urging member 192 may also include a plurality of intermediate portions 196 disposed between end portion 193 and end portion 194. The plurality of intermediate portions 196 may be portions that can be unstretched and stretched and/or compressed and uncompressed, which may allow urging member 192 as a whole to be unstretched and stretched and/or compressed and uncompressed. The plurality of intermediate portions 196 and end portions 193 and 194 may be integral portions of a single, integral urging member 192. Alternatively for example, the plurality of intermediate portions 196 may be attached to each other and to end portions 193 and 194 to form urging member 192.

Urging member 192 may be a potential-energy-storing member. Urging member 192 may be any suitable member that can be stretched and unstretched and/or compressed and uncompressed. Urging member 192 may be, for example, a tension member and/or a compression member. For example, urging member 192 may be a spring in which intermediate portions 196 may be spring coils. Urging member 192 may also be, for example, an elastic member or elastic band, a cable, a wire, and/or a member formed from materials having elastic or resilient properties and capable of being stretched and unstretched (e.g., or compressed and uncompressed). Urging member 192 may be formed from any suitable materials for forming a tension member or a compression member (e.g., that can be stretched and unstretched, or compressed and uncompressed) such as metallic material, plastic material, composite material, elastomeric material, natural rubber, and/or synthetic rubber. For example, urging member 192 may be a metallic, plastic, or composite spring. Also for example, urging member 192 may be a rubber band or an elastomeric cable, wire, or cord.

Urging member 192 may be urged or biased between a neutral or unbiased state (e.g., storing substantially no potential energy) and a biased state (e.g., storing potential energy). Because urging member 192 may be attached to both housing 110 and carriage 185, urging member 192 may be biased or unbiased based on a movement of cutting assembly 115 by a user. As illustrated in FIG. 5, urging member 192 may be in a neutral or unbiased state (e.g., storing little or substantially no potential energy) when cutting assembly 115 is in a retracted position. For example, urging member 192 may be a spring at rest (e.g., an unstretched spring) or an unstretched resilient wire or cord when in a neutral or unbiased position when cutting assembly 115 is in the retracted position illustrated in FIG. 5.

As illustrated in FIG. 4, urging member 192 may be in a biased state (e.g., storing potential energy) when cutting assembly 115 is in an extended position. For example, urging member 192 may be a stretched spring or a stretched resilient wire or cord when in a biased position when cutting assembly 115 is in the extended position illustrated in FIG. 4. A user of cutting device 105 may push on member 205 of cutting assembly 115 to move urging member 192 from the unbiased or neutral state illustrated in FIG. 5 (retracted position) to the biased state illustrated in FIG. 4 (extended position). If a user releases member 205 when cutting assembly 115 is in the extended position (e.g., when urging member 192 is in the biased state), the potential energy stored in urging member 192 may be released, thereby urging cutting assembly 115 back to the retracted state in which urging member 192 returns to a neutral or unbiased state (e.g., urging member 192 pulls cutting assembly 115 back to the retracted position if a user lets go of member 205). For example, urging member 192 may be a potential-energy-storing member that moves carriage 185 (e.g., or cutting assembly 115 including carriage 185 and cutting member 190) from the extended position toward the retracted position when potential energy is released from urging member 192. Urging member 192 may thereby urge carriage 185 (e.g., or cutting assembly 115 including cutting member 190 and carriage 185) to move from the extended position toward the retracted position. Urging member 192 may thereby operate to automatically retract cutting assembly 115 when a user is not pushing on or holding member 205 of cutting assembly 115.

The amount of bias of urging member 192 may be based on a position of cutting assembly 115. As a user moves member 205 along aperture 158 from the position illustrated in FIG. 5 to the position illustrated in FIG. 4, an increasing amount of potential energy may be stored by urging member 192 (e.g., the more urging member 192 is stretched, the more potential energy is stored by urging member 192). A user may hold member 205 at any desired position between the positions illustrated in FIGS. 4 and 5. Urging member 192 may be substantially fully biased (e.g., holding a desired maximum amount of potential energy corresponding to a predetermined amount of potential energy) when cutting assembly 115 is at the extended position (e.g., a fully extended position) illustrated in FIG. 4.

It is also contemplated that urging member 192 may be a member that stores potential energy while in an unstretched (e.g., compressed position). For example, urging member 192 may be a spring that has an unbiased or neutral state when uncompressed, and a biased state (e.g., storing potential energy) when compressed. It is contemplated that in this embodiment, the exemplary urging member would have suitable attachment positions to housing 110 and cutting assembly 115 to allow for a suitable extended position and a suitable retracted position when urging member 192 has a neutral state corresponding to a compressed (e.g., unstretched) state. In this exemplary embodiment, urging member 192 may be, for example, a compression member.

Figure 8:
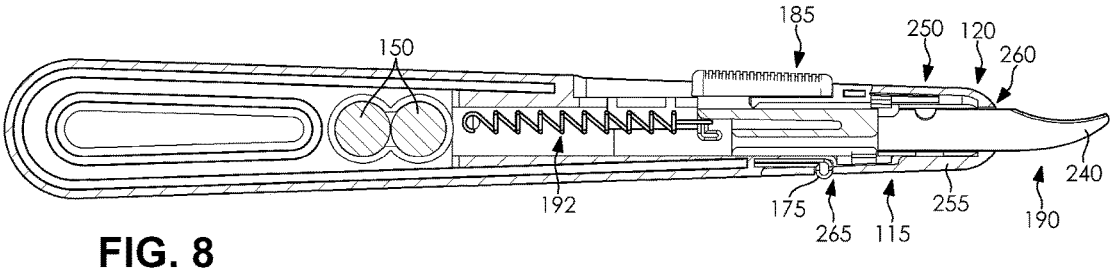
FIG. 8 is a sectional view of an exemplary cutting device in accordance with an embodiment of the present invention.

Cover member 120 may be configured to be removably attachable to housing 110. For example, cover member 120 may be a cap that is attachable to housing 110. As illustrated in FIG. 8, cover member 120 may include a cavity 250 formed by one or more wall portions 255 of cover member 120. Portions of carriage 185, cutting member 190, and/or housing 110 may be received in cavity 250 of cover member 120 (e.g., when cover member 120 is attached to housing 110). Cover member 120 may include an aperture 260 (e.g., a cutting member aperture) that may be configured to receive a portion (e.g., portion 240 and/or other portions) of cutting member 190 (e.g., when cover member 120 is attached to housing 110). Cover member 120 may also include an aperture 265 (e.g., locking member aperture) that is configured to receive a portion 175 of locking member 165 (e.g., when cover member 120 is attached to housing 110). As illustrated in FIG. 2, cover member 120 may have a portion 270 that may be diagonal or slanted or relative to a lengthwise direction (e.g., centerline 275) of cover member 120. Portion 270 may help in forming an attachment between cover member 120 and a diagonal or slanted portion of housing 110 (e.g., when portion 175 of locking member 165 is received in aperture 265).

Figure 9:
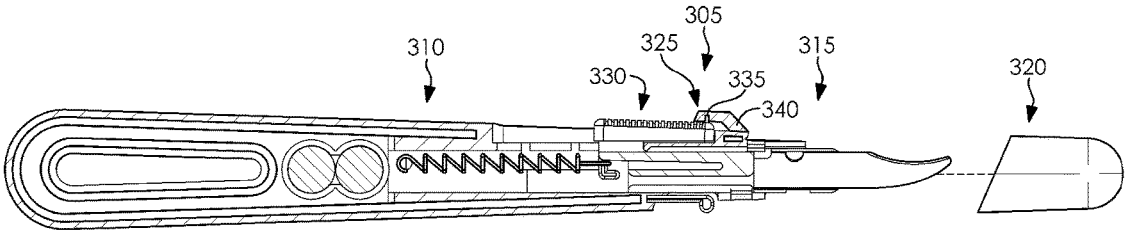
FIG. 9 is a sectional view of an exemplary cutting device in accordance with an embodiment of the present invention.

FIG. 9 illustrates an additional exemplary embodiment of the exemplary cutting device. Cutting device 305 may include a housing 310, a cutting assembly 315, and a cover member 320 that may be similar to housing 110, cutting assembly 115, and cover member 120 of cutting device 105, respectively. Cutting device 305 may also include a locking assembly 325.

Locking assembly 325 may include a protrusion 335 that may be disposed on a member 330 of cutting assembly 315. Protrusion 335 may be, for example, an integral part of member 330 or a portion of material that is similar to material of member 330 and that is attached to member 330. Locking assembly 325 may also include a locking device 340 that may be disposed on housing 310. Locking device 340 may be an integral part of housing 310 or a portion of material that is similar to the material of housing 310 and that is attached to housing 310. Locking device 340 may be a relatively flexible member based on its shape (e.g., cantilevered shape) and material, and may be moved (e.g., moved slightly away from cutting device 305) by a user. When cutting assembly 315 is in an extended position, locking device 340 may be engaged with protrusion 335 to lock cutting assembly 315 in place to housing 310. In addition to the exemplary configuration illustrated in FIG. 9, any suitable configuration may be used as a locking device to lock cutting assembly 315 to housing 310 to maintain cutting assembly 315 in the extended position. For example, a latch, hook and loop system, a friction fit locking device, a latching mechanism, a ratcheting mechanism, and/or any other suitable fastener (e.g., mechanical fastener) may be used as a locking assembly to lock cutting assembly 315 at the extended position. Locking assembly 325 when engaged may provide an attachment sufficient to overcome an urging force applied by an urging member (e.g., that may be similar to urging member 192) of cutting device 305. It is contemplated that locking assembly 325 may lock cutting assembly 315 in place at any desired position between a fully retracted position and a fully extended position. It is also contemplated that cutting device 305 may have a locking member that is similar to locking member 165, which may act to both lock cover member 320 in place on housing 310 and to also lock cutting assembly 315 in place at any desired position (e.g., an extended position).

Figure 10:
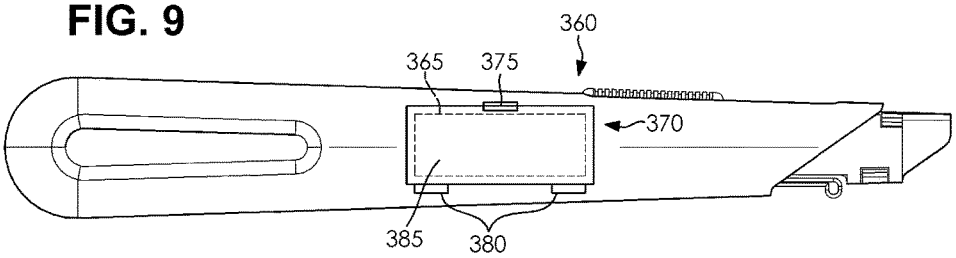
FIG. 10 is a side view of an exemplary cutting device in accordance with an embodiment of the present invention.

FIG. 10 illustrates an additional exemplary embodiment of an exemplary housing (e.g., housing 360) that may be used in conjunction with any of the exemplary embodiments disclosed herein. Housing 360 may be similar to housing 110, and may include an aperture 365 that may be selectively covered during an operation of the exemplary cutting device by an assembly 370. Assembly 370 may be any suitable assembly for selectively covering an aperture and may include, for example, a fastener 375, hinges 380, and a member 385. For example, a user may use assembly 370 to selectively cover aperture 365 by rotating member 385 about hinges 380 and fastening member 385 to housing 360 via fastener 375. Any suitable configuration may be used to selectively cover aperture 365 as an alternative embodiment to assembly 370 such as, for example, other mechanical arrangements such as a sliding member, an adhesive member, or a hook and loop system. When member 385 is unfastened and opened (e.g., rotated open), a user may access an urging member (e.g., similar to urging member 192) contained within housing 360. A user may thereby selectively remove an urging member from the exemplary cutting device to transform the cutting device from an automatically retracting cutting device (e.g., when an urging member such as urging member 192 is in place as described for example herein) to a manually retracting cutting device (e.g., when an urging member has been removed by a user via aperture 365).

Figure 11:
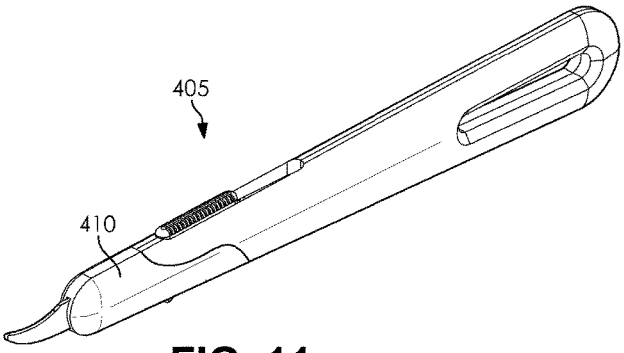
FIG. 11 is a perspective view of an exemplary cutting device in accordance with an embodiment of the present invention.
Figure 12:
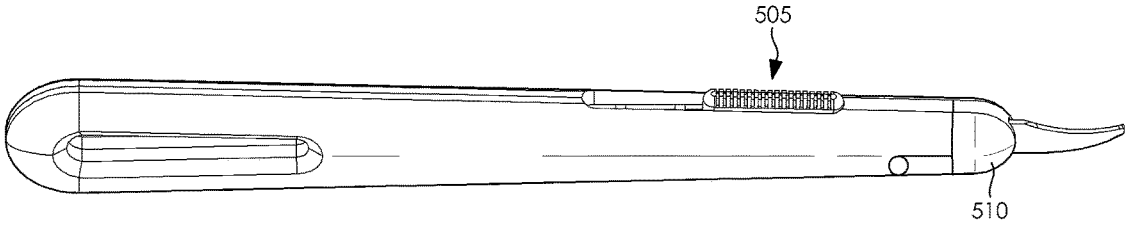
FIG. 12 is a perspective view of an exemplary cutting device in accordance with an embodiment of the present invention.
Figure 13:
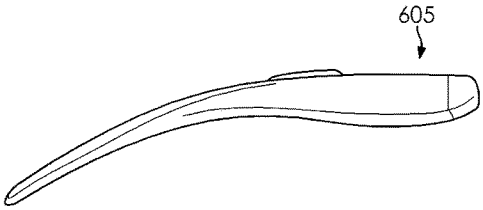
FIG. 13 is a perspective view of an exemplary cutting device in accordance with an embodiment of the present invention.

FIGS. 11, 12, and 13 illustrate additional exemplary embodiments of the present device and method. For example, FIG. 11 illustrates a cutting device 405 having a cover member 410 that may have a substantially s-shaped portion for attaching to a housing. Also for example, FIG. 12 illustrates a cutting device 505 having a cover member 510 that may have an extending portion for attaching to the housing. Further for example, FIG. 13 illustrates a cutting device 605 having an exemplary housing and cover member.

The exemplary disclosed device and method may provide an intuitively simple and safe technique for cutting materials and/or replacing blades of a cutting device. The exemplary disclosed device and method may be used in any application involving cutting materials safely. For example, the exemplary cutting device and method may be used in applications such as seam rippers, box cutters, utility knives, precision knives, and any other suitable application for cutting materials.

Figure 14:
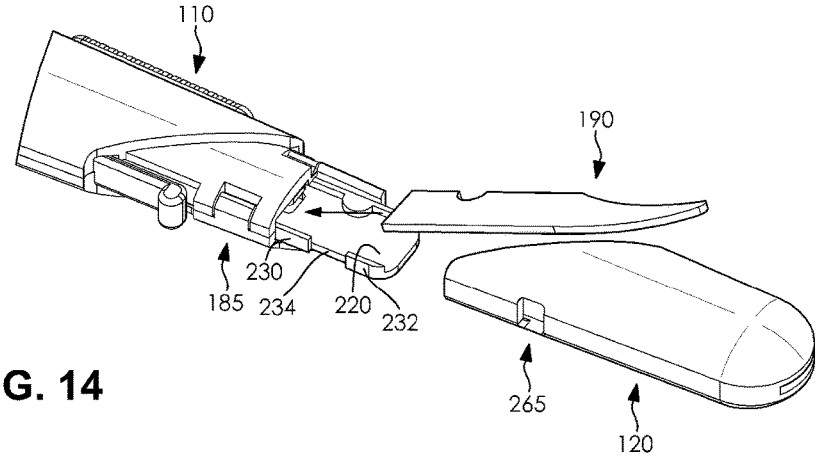
FIG. 14 is a perspective view of an exemplary cutting device in accordance with an embodiment of the present invention.

An exemplary operation of cutting device 105 will now be described. As illustrated in FIGS. 4 and 14, housing 110 is provided including locking member 165. Cutting assembly 115 is disposed in housing 110. Cutting member 190 is removably disposed in cavity 220 of carriage 185. Cover member 120 may remain detached from housing 110.

A user of cutting device 105 may push member 205 of carriage 185 to move cutting assembly 115 toward an extended position. As illustrated in FIG. 4, cutting assembly 115 including cutting member 190 disposed in carriage 185 may be pushed by a user to the extended position. When a user pushes cutting assembly 115 toward the extended position, urging member 192 moves from the unbiased or neutral state illustrated in FIG. 5 (retracted position) toward the biased state illustrated in FIG. 4 (extended position). As urging member 192 moves from the unbiased or neutral state illustrated in FIG. 5 toward the biased stated illustrated in FIG. 4, urging member 192 stores an increasing amount of potential energy (e.g., the more urging member 192 stretches, the more potential energy urging member 192 stores). Member 205 may be pushed by a user to a forward portion of aperture 158 as illustrated in FIG. 4 when cutting assembly 115 is in the extended position. When cutting assembly 115 is in the extended position, portions (e.g., portions 230 and/or 232) of carriage 185 substantially block movement (e.g., flexible movement transverse to a length of cutting device 105) of locking member 165 (e.g., substantially blocks movement of portions 170 and 175 of locking member 165).

If desired, a user may lock the exemplary cutting device in the extended position. For example, as illustrated in FIG. 9, a user may flexibly move locking device 340 slightly away from cutting device 305 when cutting assembly 315 is in the extended position, and then move locking device 340 over protrusion 335 so that locking device 340 is engaged with protrusion 335 to lock the exemplary cutting assembly (e.g., cutting assembly 315) in place to the exemplary housing (e.g., housing 310). This engagement of locking assembly 325 may resist an urging or biasing force of urging member 192 (e.g., resists a movement of urging member 192 back toward the unbiased or neutral state). If locking assembly 325 is engaged to lock cutting assembly 315 to housing 310, cutting assembly 315 will remain in the extended position even if a user stops pushing on member 330.

If a user unlocks locking assembly 325 (disengages locking device 340 from protrusion 335), the exemplary cutting assembly will move automatically from the extended position illustrated in FIG. 4 to the retracted position illustrated in FIG. 5 (e.g., the exemplary cutting device may be automatically retractable from the extended position to the retracted position; and it is also contemplated that the exemplary cutting device may be automatically retractable from the retracted position to the extended position as well). For example, urging member 192 will release stored potential energy, thereby applying a biasing or urging force to cutting assembly 115 to move cutting assembly 115 from the extended position illustrated in FIG. 4 to the retracted position illustrated in FIG. 5. For example, the biasing or urging force applied by urging member 192 may be large enough to overcome resistance (e.g., frictional forces, inertia, or other forces other than a user pushing on member 205) to move (e.g., automatically move) cutting assembly 115 (e.g., cutting assembly 115 either with or without cutting member 190) to the retracted position.

As illustrated in FIG. 10, a user may during the operation of the exemplary cutting device remove an urging member (e.g., an urging member that may be similar to urging member 192) from the exemplary cutting device by accessing the urging member by opening member 385 of assembly 370. If the exemplary urging member is removed from the cutting device by a user, the user will transform the cutting device from an automatically retracting cutting device (e.g., when an urging member such as urging member 192 is in place) to a manually retracting cutting device (e.g., when an urging member has been removed by a user via aperture 365). If the user has removed the exemplary urging member, the user may manually move cutting assembly 115 from the extended position illustrated in FIG. 4 to the retracted position illustrated in FIG. 5 by pushing member 205 of carriage 185 (e.g., or member 330 of cutting assembly 315).

Whether moved by automatic retraction or manually to the retracted position, member 205 may be disposed at a rear portion of aperture 158 as illustrated in FIG. 5 when cutting assembly 115 is in the retracted position. In the retracted position, urging member 192 may be in the unbiased or neutral state (e.g., an unstretched state in which little or substantially no potential energy is stored by urging member 192). In the retracted position, portions (e.g., portion 230 and/or 232) of carriage 185 may be substantially moved so that movement of locking member 165 (e.g., flexible movement transverse to the length of cutting device 105) is not substantially blocked (e.g., portions 170 and/or 175 of locking member 165 are not substantially blocked by portions 230 and/or 232 of carriage 185). For example, portion 175 of locking member 165 may be aligned with aperture 234 of carriage 185. For example, when portion 175 and aperture 234 are aligned, locking member 165 may be moved (e.g., flexed), so that portion 175 moves into aperture 234, which may allow a user to remove cover member 120 as disclosed herein. For example, cover member 120 may be removed when aperture 234 and portion 175 are aligned, and cover member 120 may not be removed when aperture 234 and portion 175 are not aligned.

Figure 6:
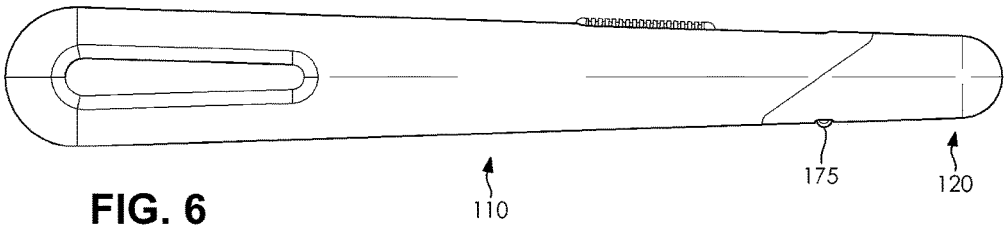
FIG. 6 is a side view of an exemplary cutting device in accordance with an embodiment of the present invention.

As illustrated in FIG. 6, a user of cutting device 105 may attach cover member 120 to housing 110 when cutting assembly 115 is in the retracted position. As cover member 120 is placed onto housing 110, locking member 165 may be moved (e.g., flexibly moved transverse to the length of cutting device 105) because locking member 165 is not substantially blocked (e.g., portions 170 and/or 175 of locking member 165 are not substantially blocked by portions 230 and/or 232 of carriage 185, and aperture 234 and portion 175 are substantially aligned). Cover member 120 may be pushed by a user onto housing 110 until portion 175 of locking member 165 is received by aperture 265 of cover member 120 as illustrated in FIG. 6.

Figure 7:
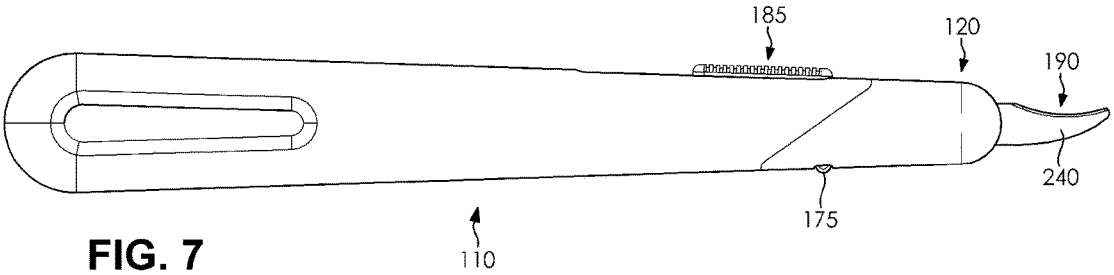
FIG. 7 is a side view of an exemplary cutting device in accordance with an embodiment of the present invention.

Cutting assembly 115 may be moved from the retracted position illustrated in FIG. 6 to the extended position illustrated in FIGS. 7 and 8. A user may move cutting assembly 115 by pushing member 205 of carriage 185. To move cutting assembly 115 to the extended position, the user applies a first force (e.g., user force or moving force) to cutting assembly 115 in an extending direction (e.g., a direction toward the extended position) that is greater than an urging force applied by urging member 192 in a retracting direction (e.g., direction toward the retracted position). The extending direction may be a substantially opposite direction as the retracting direction. When cutting assembly 115 is in the extended position, portions (e.g., portions 230 and/or 232) of carriage 185 substantially block movement (e.g., flexible movement transverse to a length of cutting device 105) of locking member 165 (e.g., substantially blocks portions 170 and/or 175 of locking member 165). Portion 240 of cutting member 190 extends through and out of aperture 260 of cover member 120. For example, when cutting member 190 is disposed in carriage 185 that is retained in housing 110 by locked cover member 120 in the extended position, cutting member 190 may extend through cutting member aperture 260 of cover member 120. For example, carriage 185 and aperture 260 may be offset from a longitudinal centerline of cutting device 105 so that when cutting member 190 is disposed in carriage 185, cutting member 190 may be offset from a longitudinal centerline of cutting device 105 (e.g., the offset may be any suitable offset for facilitating use and blade change of cutting device 105 by a user such as, for example, up to 1.5 mm, up to 1 mm, or about 0.5 mm). Portion 175 of locking member 165 remains retained in aperture 265 of cover member 120 when cutting assembly 115 is in the extended position (e.g., when a user is applying a user or moving force to member 205 that is greater than a biasing or urging force applied by urging member 192 to cutting assembly 115; or when a locking assembly similar to locking assembly 325 is in a locked state) and cover member 120 is attached to housing 110 as illustrated in FIGS. 7 and 8. For example, portion 175 (or portions 175 and 170) may act as a locking button. For example, when carriage 185 is in the extended position and cover member 120 is attached to housing 110, locking member 165 locks cover member 120 to housing 110. Locked cover member 120 (e.g., cover member 120 locked to housing 110) may thereby retain cutting member 190. For example, locking the locking member (e.g., locking member 165) to cover member 120 by moving cutting assembly 115 to the extended position may include receiving a portion (e.g., portion 175) of locking member 165 in an aperture (e.g., aperture 265) of cover member 120, and blocking a movement of portions (e.g., portion 170 and/or portion 175) of locking member 165 with cutting assembly 115 being in the extended position. In the extended position illustrated in FIGS. 7 and 8 (e.g., with cutting member 190 retained by locked cover member 120), a user may use cutting device 105 to cut material using portion 240 of cutting member 190.

It is contemplated that cutting assembly 115 may be locked in the position illustrated in FIGS. 7 and 8 similar to as described regarding cutting device 305. For example, cutting assembly 115 may be lockable in a forward position so as to cause cutting member 190 to remain extended out of aperture 260 of cover member 120. Cutting assembly 115 may be locked in the forward position by any suitable locking device such as, for example, a locking device similar to locking assembly 325.

After finishing use of cutting device 105 to cut material, a user may move cutting assembly 115 from the extended position illustrated in FIGS. 7 and 8 to the retracted position illustrated in FIG. 6 (e.g., the user may move cutting assembly 115 from the extended position to the retracted position as described herein, for example, regarding FIGS. 4 and 5). As illustrated in FIG. 5, a user of cutting device 105 may detach cover member 120 from housing 110 when cutting assembly 115 is in the retracted position. A user may move locking member 165 (e.g., flexibly moved transverse to the length of cutting device 105) because locking member 165 is not substantially blocked (e.g., movement of portions 170 and/or 175 of locking member 165 is not substantially blocked by portions 230 and/or 232 of carriage 185, and aperture 234 and portion 175 are substantially aligned). When carriage 185 is in the retracted position and cover member 120 is attached to housing 110, a portion (e.g., portion 175) of locking member 165 may be removable from aperture 265 (e.g., locking member aperture 265) and cover member 120 may be unlocked from housing 110. Portion 175 of locking member 165 may thereby be removed from aperture 265 of cover member 120. For example, unlocking locking member 165 from cover member 120 by moving cutting assembly 115 to the retracted position may include urging a portion (e.g., portion 175 and portion 170) of locking member 165 away from and out of an aperture (e.g., aperture 265) of cover member 120 when cutting assembly 115 is in the retracted position. Cover member 120 may be pushed by a user off of housing 110 as illustrated in FIG. 5.

A user of cutting device 105 may move cutting assembly 115 from the retracted position illustrated in FIG. 5 to the extended position illustrated in FIG. 4 (e.g., similar to as described above regarding FIGS. 4 and 5). For example, the user may move cutting assembly 115 to the extended position by applying a force to member 205 that is greater than a biasing or urging force applied by urging member 192 to cutting assembly 115, or a user may utilize a locking device such as locking assembly 325 to lock cutting assembly 115 in the extended position. If desired, a user may remove cutting member 190. For example, cutting member 190 may be removed from carriage 185 when cover member 120 is removed and carriage 185 is disposed in housing 110 in the extended position. For example, a user may replace a used cutting member 190 with a new cutting member 190 when cutting device 105 is in the configuration illustrated in FIG. 4 (or for example in a configuration close to the extended position). For example, a user of cutting device 105 may replace a relatively dull cutting member 190 that has been used many times for cutting material with a new cutting member 190.

The exemplary disclosed cutting device and method may provide an intuitively simple device and technique for safely and easily replacing blades of the cutting device. The exemplary device may allow users unfamiliar with the device to quickly, easily, and safely replace the blades. The exemplary device and method may also provide a user with a cutting device having a blade that may be resistant to dulling and may be used for relatively long periods of time without replacing a blade. The exemplary device and method may provide an ergonomically efficient device and method that allows a user to avoid frustration in using a cutting device, including during replacement of the device blades.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

It will be apparent to those skilled in the art that various modifications and variations can be made to the disclosed cutting device and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. A cutting device, comprising:

a housing;

a carriage that is partially disposed in the housing and movable along a portion of a length of the housing, the carriage being movable between a first position and a second position along the portion of the length of the housing, the carriage extending further out of the housing in the second position as compared to the first position;

a cutting member that is removably disposable in the carriage;

a cover member that is removably attachable to the housing, the cover member including an aperture; and an urging member having a first portion that is attached to the carriage and a second portion that is attached to the housing;

wherein the housing includes a locking member;

wherein when the carriage is in the first position and the cover member is attached to the housing, a portion of the locking member is movable into and out of the aperture of the cover member;

wherein when the carriage is in the second position and the cover member is attached to the housing, the portion of the locking member is locked in the aperture of the cover member so that the locking member locks the cover member to the housing; and wherein the urging member urges the carriage to move from the second position toward the first position both when the cover member is attached to the housing and when the cover member is detached from the housing.

2. The cutting device of claim 1, wherein the locking member is a flexible locking member configured to flexibly move in a direction that is transverse to a direction of the length of the housing.

3. The cutting device of claim 2, wherein the portion of the flexible locking member is movable into and out of the aperture of the cover member based on the flexible locking member flexibly moving in the direction that is transverse to the direction of the length of the housing.

4. The cutting device of claim 2, wherein the portion of the flexible locking member is locked in the aperture of the cover member based on a portion of the carriage blocking the flexible locking member from flexibly moving when the carriage is in the second position.

5. The cutting device of claim 1, wherein the urging member is a spring.

6. The cutting device of claim 1, wherein the cutting member includes ceramic material, and the cutting device is one of a seam ripper, a box cutter, a utility knife, or a precision knife.

7. The cutting device of claim 1, wherein the carriage includes a carriage aperture that is aligned with the portion of the locking member when the carriage is in the first position.

8. The cutting device of claim 7, wherein when the carriage is in the first position and the cover member is attached to the housing, the portion of the locking member is movable into and out of the aperture of the cover member and the carriage aperture.

9. The cutting device of claim 7, wherein the carriage aperture that is aligned with the portion of the locking member when the carriage is in the first position, and a portion of the carriage configured to block the locking member from flexibly moving when the carriage is in the second position, are both part of a wall portion of the carriage.

10. A method, comprising:

providing a housing that includes a locking member;

providing a cutting assembly, the cutting assembly including a cutting member that is removably disposed in a carriage;

partially disposing the cutting assembly in the housing, the cutting assembly being movable along a portion of a length of the housing between a first position and a second position along the portion of the length of the housing, the cutting assembly extending further out of the housing in the second position as compared to the first position;

removably attaching a cover member to the housing, the cover member including an aperture;

moving the cutting assembly to the first position, attaching the cover member to the housing, and moving a portion of the locking member into and out of the aperture of the cover member;

moving the cutting assembly to the second position with the cover member attached to the housing, and locking the cover member to the housing by locking the portion of the locking member in the aperture of the cover member when the cutting assembly is at the second position; and applying an urging force that urges the cutting assembly to move from the second position toward the first position both when the cover member is attached to the housing and when the cover member is detached from the housing;

wherein the urging force is applied by an urging member having a first portion that is attached to the cutting assembly and a second portion that is attached to the housing.

11. The method of claim 10, wherein the locking member is a flexible locking member configured to flexibly move in a direction that is transverse to a direction of the length of the housing.

12. The method of claim 11, wherein the portion of the flexible locking member is movable into and out of the aperture of the cover member based on the flexible locking member flexibly moving in the direction that is transverse to the direction of the length of the housing.

13. The method of claim 11, wherein the portion of the flexible locking member is locked in the aperture of the cover member based on a portion of the carriage blocking the flexible locking member from flexibly moving when the cutting assembly is in the second position.

14. The method of claim 10, wherein the urging member is a spring.

15. The method of claim 11, wherein the cutting member includes ceramic material.

16. The method of claim 10, wherein the cutting member is formed from Zirconium Oxide.

17. The method of claim 10, wherein the cutting device is one of a seam ripper, a box cutter, a utility knife, or a precision knife.

18. A cutting device, comprising:

a housing;

a blade carriage that is partially disposed in the housing and movable along a portion of a length of the housing, the blade carriage being movable between a first position and a second position along the portion of the length of the housing, the blade carriage extending further out of the housing in the second position as compared to the first position;

a ceramic blade that is removably disposable in the blade carriage;

a cap that is removably attachable to the housing, the cap including an aperture; and an urging member having a first portion that is attached to the blade carriage and a second portion that is attached to the housing;

wherein the housing includes a flexible locking member;

wherein when the blade carriage is in the first position and the cap is attached to the housing, a portion of the flexible locking member is movable into and out of the aperture of the cap;

wherein when the blade carriage is in the second position and the cap is attached to the housing, the portion of the locking member is locked in the aperture of the cap so that the cap is locked to the housing; and wherein the urging member urges the blade carriage to move from the second position toward the first position both when the cap is attached to the housing and when the cap is detached from the housing.

19. The cutting device of claim 18, wherein the blade carriage is maintained in the second position by applying a user force to the blade carriage in a first direction that is opposite to a second direction of an urging force applied by the urging member.

20. The cutting device of claim 18, wherein the flexible locking member is configured to flexibly move in a direction that is transverse to a direction of the length of the housing.

* * * * *